US005980059A

United States Patent [19]

Chi

[11] Patent Number: 5,980,059

[45] Date of Patent: Nov. 9, 1999

[54] PORTABLE SMOKE DISPERSING DEVICE FOR FIRES

[76] Inventor: Hsien-Tung Chi, No. 9, Hsin-I Road, Tainan, Taiwan

[21] Appl. No.: 08/907,961

[22] Filed: Aug. 11, 1997

[51] Int. Cl.[6] ..... F21V 33/00

[52] U.S. Cl. ..... 362/96

[58] Field of Search ..... 362/96

[56] References Cited

U.S. PATENT DOCUMENTS 4,433,985 2/1984 McGee ..... 55/217

5,702,299 12/1997 Sundholm ..... 454/342

*Primary Examiner*—Sandra O'Shea

*Assistant Examiner*—Todd Reed Hopper

*Attorney, Agent, or Firm*—Rosenberg, Klein & Bilker

[57] ABSTRACT

A portable smoke dispersing device includes a cylindrical body containing a motor fixed with a fan for producing a strong wind, and a jet nozzle for spraying minute water drops mixed in the strong wind to flow out of the body into dense smoke in a fire site so as to disperse dense smoke out of a room, a house, etc. Further, a power source and a water tank are attached with the body, and an illuminating lamp and laser sight are also provided for searching into dense smoke for people trapped in a fire to lead them to escape out.

1 Claim, 2 Drawing Sheets

PORTABLE SMOKE DISPERSING DEVICE FOR FIRES

BACKGROUND OF THE INVENTION

One feature of the invention is a cylindrical elongate body for containing a motor fixed with a fan, and a jet nozzle for spraying mist with water supplied from a water tank attached with the body, for producing a strong wind mixed with sprayed minute water drops.

Another feature of the invention is an illuminating lamp and a laser sight fixed on a front end of the body for shining into dense smoke for searching and saving people trapped in a fire.

One more feature of the invention is a band for shouldering the device and a grip for gripping the device for convenient carrying of the device.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
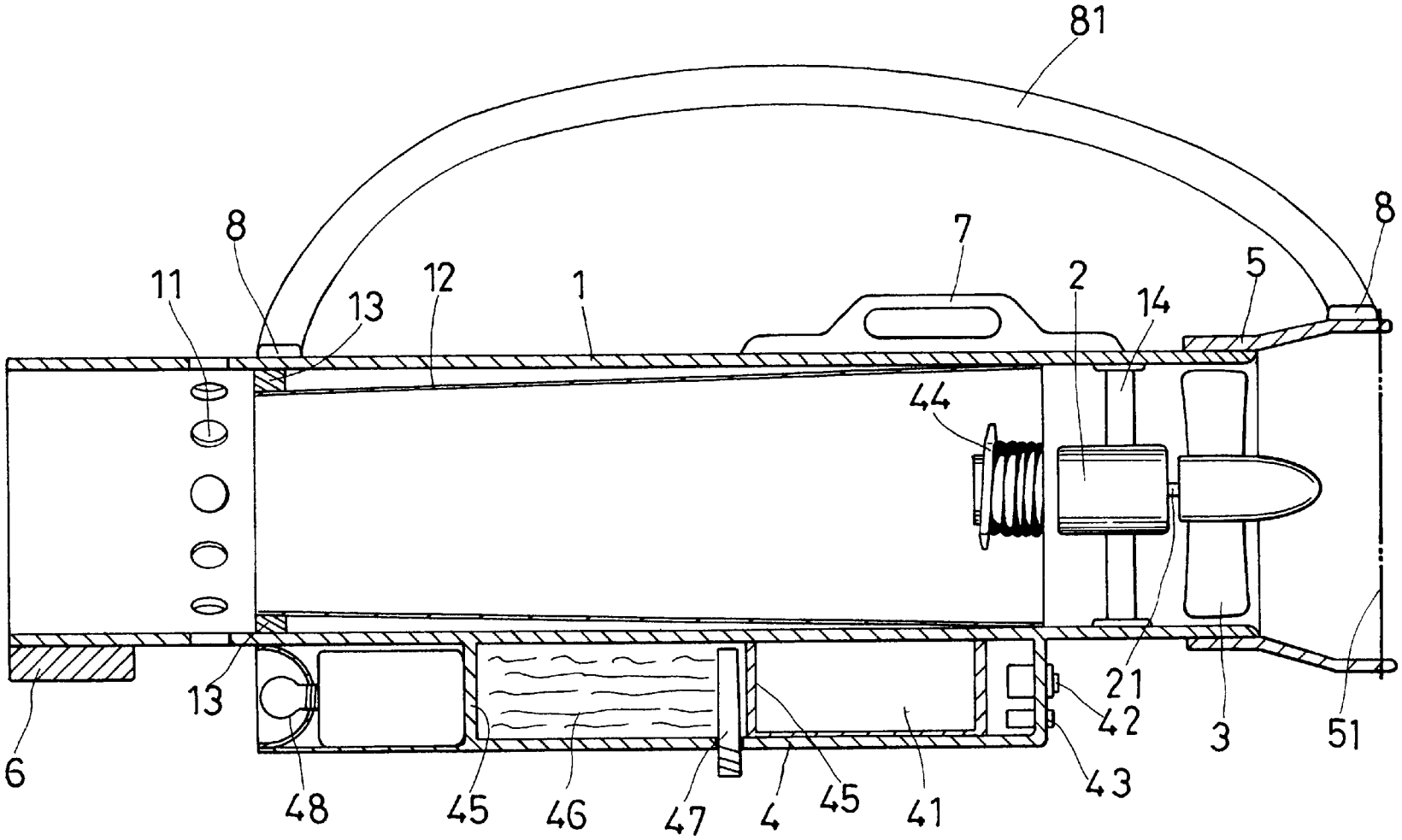
FIG. 1 is a side cross-sectional view of a portable smoke dispersing device for fires in the present invention; and, FIG. 2 is a perspective view of the portable smoke dispersing device for fires practically used in the present invention.
Figure 2:
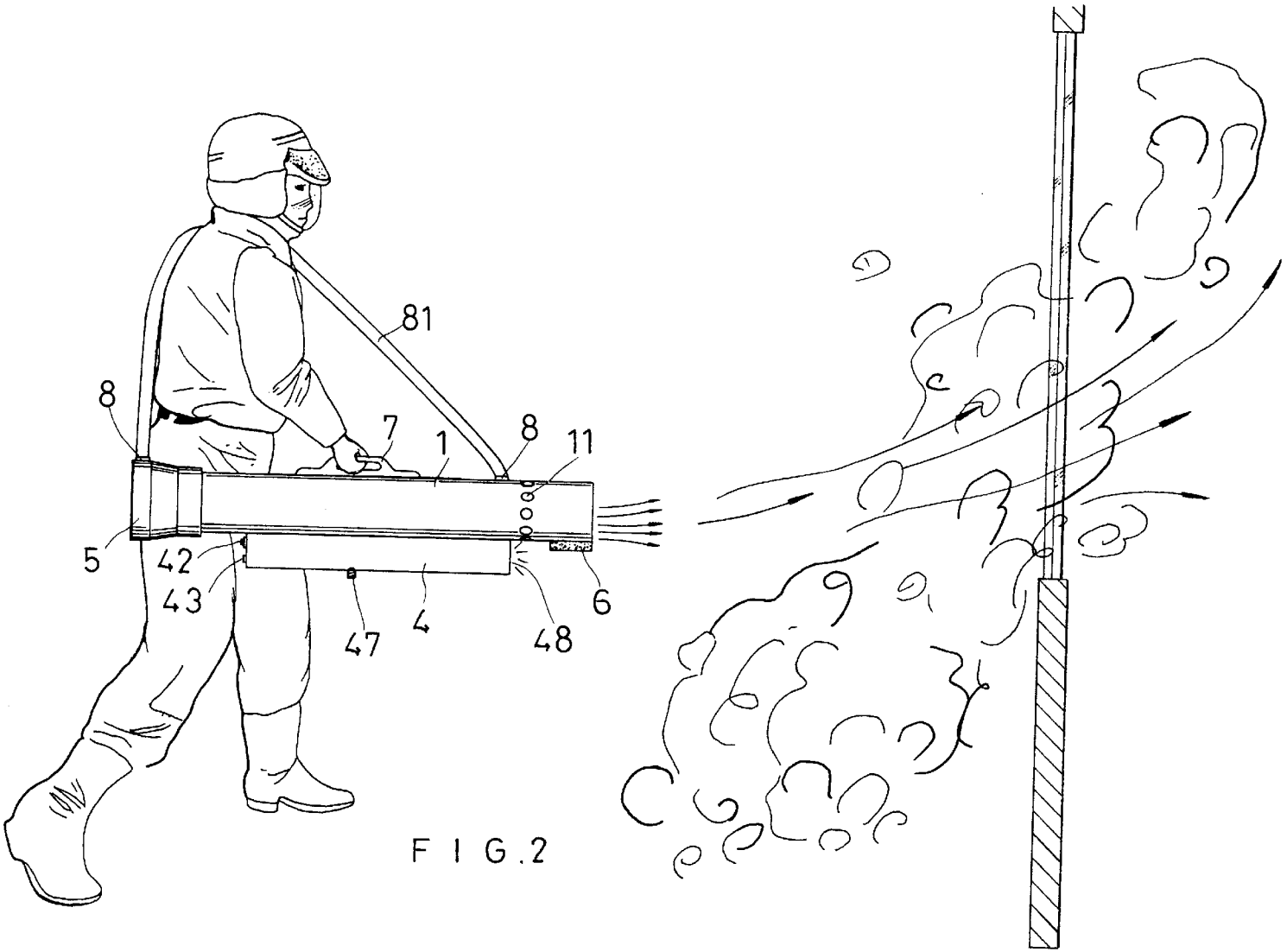

A preferred embodiment of a portable smoke dispersing device for fires, as shown in FIG. 1, includes a cylindrical elongate body 1, a motor 2, a fan 3, a jet nozzle 44, and a case 4 combined together.

The cylindrical body 1 is made of flame retarding material, having a plurality of auxiliary wind holes 11 spaced apart annularly in front portion, an inner tube 12 disposed in an inner wall of the body 1 and sloping gradually narrower from a rear portion to the front portion near the wind holes 11 of the cylindrical body 1, a ring gasket 13 fitting around the front end of the inner tube 12 and around the inner wall of the body 1. Further, the body 1 has an air-guiding support frame 14 fixed in a rear portion for securely supporting a motor 2 thereon.

The motor 2 has a shaft 21 and a fan 3 fixed on the shaft 21, connected with a power source 41 contained in a case 4 attached under the body 1. The case 4 has a switch 42 for turning on and off the motor 2, and a charge socket 43 for charging the power source 41.

The jet nozzle 44 is provided in front of the fan 3, connected with a water tank 46 by a guide tube, and a faucet 47 provided under the water tank 46. The water tank 46 is fixed in the case 4 and disposed between separating plates 45.

A trumpet-shaped mouth 5 is provided to fit around a rear outer end of the body 1, closed with a wire net 51 for open air to flow through in said body.

An illuminating lamp 48 of strong light is provided under the front portion of the body 1, a laser sight 6 is fixed on a front end of the body 1, a grip 7 fixed on the rear portion of the body 1, and a band 81 for shouldering the device is fixed on the body 1 with two fix members 8, 8.

In using this portable smoke dispersing device, a user shoulders the band 81, with a hand gripping the grip 7, directing the front portion with the auxiliary wind holes 11 of the cylindrical body 1 towards dense smoke in a fire site, coming from a window, a door, etc. Then the switch 42 of the power source 41 is turned on to operate the motor 2, which rotates the fan 3 for producing strong wind with high speed. In the meantime, the pump of the water tank 46 also operates to supply water to the jet nozzle 44, which then sprays minute water drops to be blown by the wind produced by the fan 3 rotating with 40,000 revolutions per minute. Meanwhile, air comes from the trumpet-shaped mouth, with the wire net preventing small miscellaneous matters from entering the body 1. The minute water drops sprayed out of the jet nozzle 44 can be blown by the strong wind towards dense smoke from a fire, not only lowering temperature of the fire, but also condensing miscellaneous matters in the smoke to lessen the dense smoke. The inner tube 12 increases air pressure to a larger extend than open air, with augmenting air volume coming in the cylindrical body 1 through the auxiliary wind holes 11.

On the other hand, light produced by the illuminating lamp 48 in cooperation with the light beam produced by the laser sight 6 is directed on walls, furniture, or darkened window glass, for ascertaining the environment of the fire. Then window glass can be opened or broken for dense smoke to flow out of a room, a house or a building, and with help of the portable smoke dispersing device, firemen can speedily save people trapped in the fire.

Where a site of a fire is only just in a beginning stage it has flammable gas that could possibly explode at any time if there should be a spark. In order to prevent such an explosion, this invention is safer by using an anti-explosion pressure pump, thereby becoming a smoke dispersing device operated by pressure.

As can be understood from the above description, this invention has advantages as follows.

1. Dense smoke at a fire site can be dispersed by a strong wind mixed with minute water drops produced by the fan rotating with speed of 40,000 revolutions per minute, enabling firemen to enter therein for speedily saving people.
2. Minute water drops mixed in the strong wind produced in the smoke dispersing device functions to lower high temperature of a fire site and condense miscellaneous matters in the dense smoke, preventing firemen and trapped people from being stifled by dense smoke or poisoned and lose consciousness.
3. It has a band for easy carrying on a user's shoulder and a grip for gripping by a hand and a chargeable power source without requiring additional power, so that a user can swiftly operate the present invention.
4. It has an illuminating lamp coordinated with a laser sight for searching for windows or doors in dense smoke of a fire site, to attain the goals of saving people and extinguishing a fire.

What is claimed is:

1. A portable smoke dispersing device comprising:

a cylindrical body made of flame retardant material, having a plurality of auxiliary wind holes spaced apart annularly in a front portion, an inner tube having an annular wall sloping to a smaller diameter adjacent said front portion and secured thereat by a ring gasket fitted between an inner surface of said cylindrical body and an outer surface of said inner tube;

a motor supported on a support frame fixed firmly in a rear portion of said cylindrical body, a fan fixed on a shaft of said motor for producing a strong wind to flow out of a front end of said cylindrical body;

a case fixed under said cylindrical body for containing a power source electrically connected with said motor, a switch on an outer surface for turning on and off said motor, a charge socket for charging said power source;

a jet nozzle provided in said cylindrical body in front of said motor, connected to a water tank by a tube, said water tank being fixed in said case and separated with separating plates, a faucet fixed to said water tank, a trumpet-shaped mouth fixed to a rear end of said cylindrical body, a wire net provided across said trumpet-shaped mouth for air to flow through;

an illuminating lamp of strong light fixed under said cylindrical body in front of said water tank and providing sufficient light to see through dense smoke, a laser sight fixed under a front end of said cylindrical body and producing a light beam, a band for shouldering said device and a grip provided on an upper side of said body for gripping said device with a user's hand; and, said cylindrical body being carried by a user with said band and said grip in a fire site, said front end of said cylindrical body being directed towards dense smoke coming out of a window or a door in the fire site, said switch being turned on to let said fan rotate to produce a strong wind with air coming in through said trumpet-shaped mouth, said jet nozzle spraying out minute water drops with the water coming from said water tank through said tube, said inner tube increasing pressure of said strong wind produced by said fan, said auxiliary wind holes inducing ambient air to enter said cylindrical body through said auxiliary wind holes to increase a volume of said strong wind flowing out of said cylindrical body, said strong wind coming out of said cylindrical body for lowering temperature of dense smoke and condensing miscellaneous matters therein at the same time and dispersing dense smoke out of the fire site.

* * * * *